US012042117B2

(12) United States Patent
Sauer et al.

(10) Patent No.: US 12,042,117 B2
(45) Date of Patent: Jul. 23, 2024

(54) RETAINER PLATE WITH A SEAL ELEMENT

(71) Applicant: Eurofilters Holding N.V., Overpelt (BE)

(72) Inventors: Ralf Sauer, Overpelt (BE); Jan Schultink, Overpelt (BE)

(73) Assignee: EUROFILTERS HOLDING N.V., Overpelt (BE)

( * ) Notice: Subject to any disclaimer, the term of this patent is extended or adjusted under 35 U.S.C. 154(b) by 961 days.

(21) Appl. No.: 16/975,039

(22) PCT Filed: Feb. 20, 2019

(86) PCT No.: PCT/EP2019/054179
§ 371 (c)(1),
(2) Date: Aug. 21, 2020

(87) PCT Pub. No.: WO2019/162307
PCT Pub. Date: Aug. 29, 2019

(65) Prior Publication Data

US 2020/0390304 A1 Dec. 17, 2020

(30) Foreign Application Priority Data

Feb. 23, 2018 (EP) ..... 18158393

(51) Int. Cl.
*A47L 9/14* (2006.01)

(52) U.S. Cl.
CPC ..... *A47L 9/1436* (2013.01)

(58) Field of Classification Search
CPC .... A47L 9/1436; A47L 9/1445; A47L 9/1454; A47L 9/14; A47L 9/1427; B01D 2279/55
See application file for complete search history.

(56) References Cited

U.S. PATENT DOCUMENTS

| | | | |
|---|---|---|---|
| 2,347,899 | A | 5/1944 | Forsythe |
| 3,231,089 | A | 1/1966 | Thornton |
| 3,283,481 | A | 11/1966 | Studley et al. |
| 3,383,030 | A | 5/1968 | Downey |
| 3,401,867 | A | 9/1968 | Long et al. |
| 3,491,519 | A | 1/1970 | Ettridge |
| 4,364,757 | A | 12/1982 | Leonatti |
| 4,924,923 | A | 5/1990 | Boehmer |

(Continued)

FOREIGN PATENT DOCUMENTS

| | | |
|---|---|---|
| AU | 2017381004 B2 | 7/2019 |
| CH | 483 247 | 12/1969 |

(Continued)

OTHER PUBLICATIONS

Computer generated English Translation of DE 202015008776 U1, Eurofilters, Jan. 2016. (Year: 2016).*

(Continued)

*Primary Examiner* — Laura C Guidotti
(74) *Attorney, Agent, or Firm* — Crowell & Moring LLP

(57) ABSTRACT

The invention relates to a retainer plate for a vacuum cleaner filter bag, comprising a base plate in which a passage opening is formed, and a sealing element which is arranged at the edge of the passage opening, wherein the sealing element comprises at least one extruded film made of a thermoplastic elastomer, TPE.

15 Claims, 1 Drawing Sheet

(56) References Cited

U.S. PATENT DOCUMENTS

Figure 1:
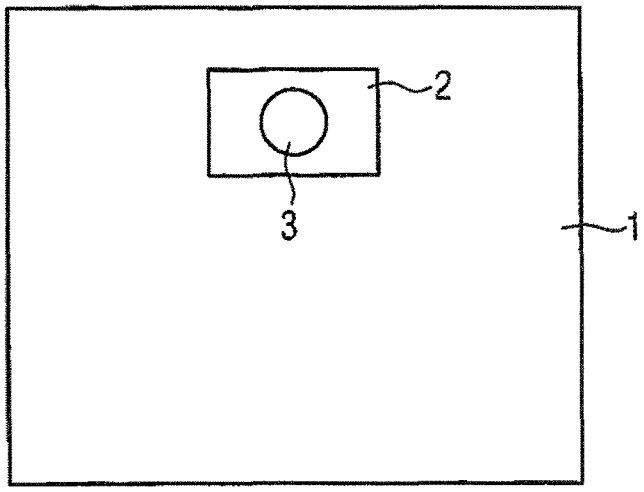

| | | | | |
|---|---|---|---|---|
| 5,039,324 | A | 8/1991 | Goldberg | |
| 5,052,594 | A | 10/1991 | Sorby | |
| 5,688,298 | A | 11/1997 | Bosses | |
| 5,820,643 | A | 10/1998 | Leinenlüke et al. | |
| 6,716,262 | B2 | 4/2004 | Zimet et al. | |
| 7,341,612 | B2 * | 3/2008 | Nhan | A47L 9/1436 15/348 |
| D600,868 | S | 9/2009 | Rennecker et al. | |
| 7,662,200 | B2 | 2/2010 | Knuth et al. | |
| 7,794,516 | B2 | 9/2010 | McAllise et al. | |
| 2002/0020155 | A1 | 2/2002 | Stokmans | |
| 2007/0175817 | A1 | 8/2007 | Goldman | |
| 2008/0127832 | A1 | 6/2008 | Zhang | |
| 2009/0223190 | A1 | 9/2009 | Nauta et al. | |
| 2009/0272083 | A1 | 11/2009 | Sauer et al. | |
| 2010/0269829 | A1 | 10/2010 | Hansmann et al. | |
| 2011/0030557 | A1 | 2/2011 | Brownstein et al. | |
| 2012/0211625 | A1 | 8/2012 | Schultink | |
| 2014/0352102 | A1 * | 12/2014 | Schultink | A47L 9/1445 15/347 |
| 2018/0354239 | A1 * | 12/2018 | Hua | B32B 27/32 |
| 2019/0208973 | A1 | 7/2019 | Werius et al. | |
| 2019/0313869 | A1 | 10/2019 | Scheufen et al. | |
| 2019/0350421 | A1 | 11/2019 | Werius et al. | |

FOREIGN PATENT DOCUMENTS

| | | | | |
|---|---|---|---|---|
| CN | 1327374 | A | 12/2001 | |
| CN | 101259003 | A | 9/2008 | |
| CN | 101360442 | A | 2/2009 | |
| CN | 101431930 | | 5/2009 | |
| CN | 101747596 | A | 6/2010 | |
| CN | 102368988 | A | 3/2012 | |
| CN | 202730890 | | 2/2013 | |
| CN | 102984980 | A | 3/2013 | |
| CN | 103354738 | A | 10/2013 | |
| CN | 106455885 | A | 2/2017 | |
| CN | 107205596 | A | 9/2017 | |
| CN | 207270312 | U | 4/2018 | |
| CN | 108078493 | A | 5/2018 | |
| CN | 109068915 | A | 12/2018 | |
| CN | 109152504 | A | 1/2019 | |
| DE | 1 628 582 | | 2/1968 | |
| DE | 1301881 | B | 8/1969 | |
| DE | 2533590 | A1 | 2/1977 | |
| DE | 0 202 639 | A2 | 11/1986 | |
| DE | 8622890 | U1 | 12/1987 | |
| DE | 88 11 821 | U1 | 12/1988 | |
| DE | 3714780 | A1 | 12/1988 | |
| DE | 90 16 893 | U1 | 4/1991 | |
| DE | 90 16 939 | U1 | 5/1991 | |
| DE | 91 01 981 | U1 | 6/1991 | |
| DE | 9110724 | U1 | 11/1991 | |
| DE | 93 16 626 | U1 | 2/1995 | |
| DE | 44 15 350 | A1 | 11/1995 | |
| DE | 296 14 272 | U1 | 9/1996 | |
| DE | 296 15 163 | U1 | 1/1997 | |
| DE | 298 11 799 | U1 | 9/1998 | |
| DE | 298 19 699 | U1 | 2/1999 | |
| DE | 19806452 | A1 | 8/1999 | |
| DE | 200 05 448 | U1 | 6/2000 | |
| DE | 20010049 | U1 | 10/2000 | |
| DE | 199 19 809 | A1 | 11/2000 | |
| DE | 199 48 909 | A1 | 4/2001 | |
| DE | 102 03 460 | A1 | 8/2002 | |
| DE | 102 03 405 | A1 | 8/2003 | |
| DE | 10221694 | A1 | 12/2003 | |
| DE | 203 16 574 | U1 | 2/2004 | |
| DE | 202004008971 | U1 | 8/2004 | |
| DE | 20 2006 016789 | U1 | 12/2006 | |
| DE | 10 2005 027 078 | A1 | 1/2007 | |
| DE | 20 2006 020 047 | U1 | 10/2007 | |
| DE | 10 2006 037 456 | A1 | 2/2008 | |
| DE | 10 2006 055 890 | A1 | 5/2008 | |
| DE | 20 2008 003 248 | U1 | 6/2008 | |
| DE | 20 2008 005 050 | U1 | 7/2008 | |
| DE | 20 2008 004 733 | U1 | 11/2008 | |
| DE | 10 2008 046 200 | A1 | 4/2009 | |
| DE | 10 2007 053 151 | A1 | 5/2009 | |
| DE | 10 2007 057 170 | A1 | 5/2009 | |
| DE | 10 2007 062 028 | A1 | 6/2009 | |
| DE | 20 2008 001 391 | U1 | 7/2009 | |
| DE | 202008004025 | U1 | 8/2009 | |
| DE | 20 2008 006 904 | U1 | 11/2009 | |
| DE | 10 2008 041 227 | A1 | 2/2010 | |
| DE | 20 2008 018 054 | U1 | 6/2011 | |
| DE | 2020 11103174 | U1 | 10/2011 | |
| DE | 202011102509 | U1 | 11/2011 | |
| DE | 10 2010 060 175 | A1 | 3/2012 | |
| DE | 10 2011 008 117 | A1 | 4/2012 | |
| DE | 10 2010 060 353 | A1 | 5/2012 | |
| DE | 10 2011 105 384 | A1 | 12/2012 | |
| DE | 20 2013 001 096 | U1 | 4/2013 | |
| DE | 20 2011 052 208 | U1 | 5/2013 | |
| DE | 20 2013 100 862 | U1 | 5/2013 | |
| DE | 10 2012 012 999 | A1 | 7/2013 | |
| DE | 20 2013 103 508 | U1 | 10/2013 | |
| DE | 10 2014 109 596 | A1 | 2/2015 | |
| DE | 20 2015 101 218 | U1 | 5/2015 | |
| DE | 20 2014 100 563 | U1 | 6/2015 | |
| DE | 202015008776 | U1 * | 1/2016 | A47L 9/14 |
| DE | 20 2016 003 890 | U1 | 8/2016 | |
| DE | 10 2005 041 811 | A1 | 3/2017 | |
| DE | 102018101075 | A1 | 7/2019 | |
| DE | 10 2020 103084 | A1 | 12/2021 | |
| EP | 0179950 | A1 | 5/1986 | |
| EP | 0 361 240 | A1 | 4/1990 | |
| EP | 0 758 209 | A1 | 11/1995 | |
| EP | 0 960 645 | A2 | 12/1999 | |
| EP | 1 198 280 | A1 | 1/2001 | |
| EP | 1 137 360 | A1 | 4/2001 | |
| EP | 1 254 693 | A2 | 11/2002 | |
| EP | 1258277 | A1 | 11/2002 | |
| EP | 1 480 545 | A1 | 9/2003 | |
| EP | 1327411 | B1 * | 5/2006 | A47L 9/1427 |
| EP | 1695649 | A1 | 8/2006 | |
| EP | 1721555 | A1 | 11/2006 | |
| EP | 1 795 247 | A1 | 6/2007 | |
| EP | 1 795 427 | A1 | 6/2007 | |
| EP | 1 917 897 | A2 | 5/2008 | |
| EP | 1917895 | B1 | 5/2008 | |
| EP | 2004303 | B1 | 12/2008 | |
| EP | 2 011 556 | A1 | 1/2009 | |
| EP | 2 044 874 | A2 | 4/2009 | |
| EP | 2 123 206 | A1 | 11/2009 | |
| EP | 2 044 874 | B1 | 9/2010 | |
| EP | 2 263 508 | A1 | 12/2010 | |
| EP | 2 442 703 | A1 | 12/2010 | |
| EP | 2 301 404 | A2 | 3/2011 | |
| EP | 2 433 695 | A1 | 3/2012 | |
| EP | 1795248 | B1 | 10/2016 | |
| EP | 3178360 | A1 | 6/2017 | |
| EP | 3 219 373 | A1 | 9/2017 | |
| EP | 3 219 374 | A1 | 9/2017 | |
| EP | 3 219 375 | A1 | 9/2017 | |
| FR | 2 721 188 | A1 | 12/1995 | |
| GB | 651916 | A | 4/1951 | |
| GB | 2033248 | A | 5/1980 | |
| RU | 2524330 | C2 | 10/2013 | |
| WO | WO 1995/029621 | A1 | 11/1995 | |
| WO | WO 01/003802 | A1 | 1/2001 | |
| WO | WO 2001/26526 | A1 | 4/2001 | |
| WO | WO 2001/078571 | A1 | 10/2001 | |
| WO | WO 03/073903 | A1 | 9/2003 | |
| WO | WO 2003/73903 | A1 | 9/2003 | |
| WO | WO 07/121979 | A1 | 11/2007 | |
| WO | WO 11/047764 | A1 | 4/2011 | |
| WO | WO 11/057641 | A1 | 5/2011 | |
| WO | WO 13/106392 | A2 | 7/2013 | |
| WO | WO 2014/074398 | A2 | 5/2014 | |
| WO | WO2017098035 | A1 | 6/2017 | |
| WO | WO 2017/194081 | A1 | 11/2017 | |

(56) References Cited

FOREIGN PATENT DOCUMENTS

| | | |
|---|---|---|
| WO | WO 2017/196211 A1 | 11/2017 |
| WO | WO 2018/095519 A1 | 5/2018 |
| WO | WO 2018/115269 A1 | 6/2018 |

OTHER PUBLICATIONS

Computer generated English Translation of DE 202008004025 U1, Wolf PVG Gmbh, Aug. 2009. (Year: 2009).*
Computer generated English translation of EP 1327411 B1, Krehan et al., May 2006. (Year: 2006).*
Computer generated English translation of DE 202004008971 U1, Branofilter, Aug. 2004. (Year: 2004).*
East Bavarian Technical College: construction course in plastics technology East Bavarian Technical University Amberg-Weiden; Study content for the course of plastics technology; downloaded from the internet on May 23, 2019 at https://www.oth-aw.de/studiengaenge-und-bildungsangbote/studienangebote/bachelor-studiengaenge/kunststofftechnik/aufbau/; 10 pages including English translation.
European Standard No. DIN EN 15347: Plastics, Recycled Plastics, Characterisation of Plastics Wastes, English Version; ICS 13.030.50; 83.080.01; Feb. 2008; 12 pages.
Shen, Li et al.; "Open-loop recycling: A LCA case study of PET bottle-to-fibre recycling"; Resources, Conservation and Recycling, vol. 55; Nov. 1, 2010; pp. 34-52.
Lueger; Encyclopedia of the entire technology: Staple Fiber 600 (Neuschappe); downloaded from the Internet on Aug. 29, 2019 at http://www.zeno.org/Lueger-1904/A/Stapelfaser; 1920; including English translation.
International Search Report mailed Jun. 7, 2019 for International Application No. PCT/EP2019/054179 (English and German languages) (10 pp.).
Examination Report No. 1 issued on Mar. 12, 2021, for Australian Patent Application No. 2019225973 (6 pgs.).
European Search Report for EP Application No. 19218702.9 dated Sep. 22, 2020 (5 pages).
International Search Report and Written Opinion for PCT/EP2020/086144 (with translation) dated Mar. 16, 2021 (18 pages).
International Search Report in European Application No. EP 18158368, dated Aug. 31, 2018 (8 pages).
Search Report from the First Office Action in Russian Application No. 2020134231/03 (062803) dated Feb. 12, 201 (2 pages).
International Search Report mailed Apr. 16, 2018 for International Application No. PCT/EP2017/084066 (10 pages).
Australian Examination Report issued on Feb. 18, 2020 for Australian International Application No. 2017381004 (5 pages).
Second Office Action dated Apr. 14, 2021, for the corresponding International Chinese Application No. 201780078687.2 (English Translation attached) (21 pages).
Non-Final Office Action in U.S. Appl. No. 16/969,916, dated Aug. 23, 2023 (16 pages).
Non-Final Office Action in U.S. Appl. No. 16/472,614, dated Oct. 30, 2023 (71 pages).
Notification of the first Chinese Office Action and Search Report regarding 202080087367.5 dated Sep. 19, 2023, 7 pages.

* cited by examiner

RETAINER PLATE WITH A SEAL ELEMENT

This application claims the benefit under 35 U.S.C. § 371 of International Application No. PCT/EP2019/054179, filed Feb. 20, 2019, which claims the priority of European Patent Application No. 18158393.1 filed Feb. 23, 2018, which are incorporated by reference herein in their entirety.

The invention relates to a retainer plate for a vacuum cleaner filter bag, wherein the retainer plate comprises a base plate with a passage opening arranged therein and a seal element arranged at the edge of the passage opening.

Such retainer plates are known in various forms for arranging a vacuum cleaner filter bag connected thereto in a vacuum cleaner housing. During operation, a nozzle of the vacuum cleaner is usually inserted into the passage opening of the base plate to direct the suction air flow into the bag. Since retainer plates usually have to fit different nozzle diameters, many solutions provide an elastic seal (sealing ring) to compensate for the differences in diameter of the nozzles. The seal element is usually formed by a sealing lip made of a thermoplastic elastomer, TPE, which is molded onto the edge of the base plate's passage opening. However, it is also known to use the bag material of the vacuum cleaner filter bag itself as the sealing ring, as is disclosed for example in DE 102 03 460. It is also possible to use a sealing membrane between retainer plate 2 and bag wall 1, as disclosed in EP 2 044 874.

It has been found that the elasticity of the seal elements used is often insufficient to ensure a sufficient sealing effect. Therefore, leakage between nozzle and seal element may occur.

It is therefore the object of the invention to provide a retainer plate with a seal element which ensures a reliable seal during operation.

This object is achieved by a retainer plate according to claim 1. Particularly advantageous developments can be found in the sub-claims.

According to the invention, it is thus intended that the seal element comprises at least one extruded film made of a thermoplastic elastomer, TPE. It has been shown that such extruded films are more suitable than known seal elements, in particular molded-on TPE sealing lips. The film can also be made significantly thinner than injection-molded sealing lips, because flat and elongated cavities cannot be reliably filled in the injection-molding process. The seal element as claimed therefore makes it possible to reliably seal the nozzle inserted into the passage opening during operation.

The retainer plate can be attached to a retaining device in a vacuum cleaner housing. This means that the retainer plate can be arranged in a predetermined position in the vacuum cleaner housing, in particular it can be fixed. Alternatively, the vacuum cleaner filter bag can be pushed over a connection nozzle on the vacuum cleaner side by using the retainer plate.

"Arranged at the edge of the passage opening" here means that the seal element projects at least partially over the edge of the passage opening towards the passage opening and thus at least partially overlaps with the passage opening. The seal element thus forms a sealing lip for the passage opening of the base plate. This allows a vacuum cleaner nozzle which is inserted into the passage opening to come into contact with the seal element.

The seal element can be arranged in the same plane as the base plate, in particular as the passage opening. In this case, the seal element may thus be arranged partly or completely along the circumference of the passage opening.

However, it is also possible that the seal element is arranged in a plane arranged parallel to the plane of the passage opening. The seal element can be arranged in particular on the base plate side which serves to connect to the bag wall of a vacuum cleaner filter bag.

The seal element also comprises a passage opening, which can be arranged in particular concentrically to the passage opening in the base plate. The area of the passage opening in the seal element is smaller than the area of the passage opening in the base plate. This ensures that a nozzle of the vacuum cleaner comes into contact with the seal element during operation when it is inserted into the passage opening in the base plate.

In the case of a circular passage opening in the base plate, the passage opening in the seal element can also be made circular. In this case, the inner diameter of the passage opening in the seal element is smaller than the inner diameter of the passage opening in the base plate. In the case of a differently shaped passage opening, the inner diameter can be replaced by the maximum extension in the plane of the passage opening. In this case, the maximum extension of the passage opening in the seal element is thus smaller than the maximum extension of the passage opening in the base plate. The passage opening in the base plate and the passage opening in the seal element can have the same or a different shape.

In the simplest case, the seal element is ring-shaped. However, any other shape is also conceivable as long as a passage opening in the seal element overlaps at least partially with the passage opening in the base plate so that a vacuum cleaner nozzle can be inserted into the passage opening in the base plate and the passage opening in the seal element.

The base plate can also have any shape, which can correspond in particular to the corresponding retaining device in the vacuum cleaner housing. However, the base plate is generally a flat component, wherein the thickness of the base plate in particular is significantly less than the extension of the base plate in a plane perpendicular to it (length/width).

The at least one extruded film can be a blown film or a cast film.

The at least one extruded film may have a first side and an opposite second side, the first side having a greater roughness than the second side. The first side with the greater roughness may be arranged during operation of the retainer plate such that it comes into contact with the nozzle of the vacuum cleaner which is inserted into the passage opening. On the other hand, the second side with the lower roughness may point away from the surface of the nozzle, especially towards the dust compartment of a filter bag connected to the retainer plate. This makes it easier to insert the nozzle into the passage opening. If the surface of the seal element is too smooth, this could cause the nozzle to stick, so to speak, to the seal element, so that high static friction must be overcome in order to insert the nozzle. On the smoother second side, on the other hand, it is more difficult for suction material to adhere due to the lower roughness, so that an undesirable filter cake does not form in the area of the passage opening or does not form as strongly.

The melt flow index of the thermoplastic elastomer of the at least one extruded film can be less than 10 g/10 min, especially less than 5 g/10 min, especially less than 3 g/10 min. Thus, the melt flow index is significantly lower than that of plastics used in the injection molding process. The reason is that injection molding processes require plastics with a melt flow index of more than 40 g/10 min.

The thickness of the at least one extruded film can be less than 0.35 mm, in particular less than 0.25 mm, in particular less than 0.15 mm. Here, the thickness of the film may in particular be constant. Such thin structures cannot be produced in the injection molding process because the flat and elongated cavities required for this purpose could not be filled. Therefore, only structures, especially seal elements, with a thickness of more than 0.4 mm can be produced in the injection molding process.

The at least one extruded film can be connected, especially welded, to the base plate. The at least one extruded film can be connected, in particular (ultrasonically) welded, to the base plate either directly or via a connection layer, which in particular comprises a nonwoven fabric. A connection layer can be used, for example, if the plastic material of the base plate is incompatible with the plastic material of the seal element. In the latter case, the plastic material of the base plate would essentially not mix with the plastic material of the seal element, so that these plastics would not be directly weldable together.

The seal element may also comprise several layers of extruded films made of a thermoplastic elastomer, TPE (especially produced by co-extrusion). Thus, a multi-layer seal element can be provided. It is also possible to combine one or more layers of extruded films made of a thermoplastic elastomer, TPE, with one or more layers of nonwoven fabric to form a seal element.

Each of the layers can then have arranged therein a passage opening, the passage openings being arranged coaxially and thus forming the passage opening of the seal element. The diameter of the passage openings in the individual layers can be the same or different in size.

At least two of the layers of extruded films can consist of different plastics. In particular, it is possible to form the layer facing the base plate from a plastic material which can be advantageously (ultrasonically) welded to the base plate. The one or more further layers, on the other hand, can be optimized, for example, for elasticity and thus sufficient sealing effect.

The several layers of extruded films (possibly with one or more layers of nonwoven fabric) can be joined together, in particular welded or bonded. The several layers may be joined together, in particular in an area where the seal element is not also connected to the base plate. Thus, the layers of the seal element can already be joined together before connection to the base plate, which facilitates production, since it is not necessary to position several layers of the seal element, each with a passage opening, in relation to each other and to the base plate and its passage opening.

If two or more layers of extruded films or at least one layer of an extruded film together with at least one layer of nonwoven fabric are used, the diameters of the passage openings in the individual layers may be the same or different in size.

If both passage openings are of the same size, the nonwoven layer may be arranged towards the nozzle. The rough surface of the nonwoven fabric then has a similar effect as the roughening of the one film side, as described above. The diameters of the passage openings can also be different. This allows even better adaptation to different nozzle diameters. It can be helpful if the film with the smaller diameter of the passage opening has a high elasticity and, if necessary, a low thickness, while the film with the larger diameter of the passage opening has a lower elasticity and a greater thickness, in order to additionally take over a centering function of the nozzle in the passage opening.

In the case of a nonwoven layer, it can be helpful—especially if the opening diameter of the passage opening is smaller than that of the adjacent film layer—to cut in the edge of the nonwoven fabric several times.

The base plate can comprise or consist of a thermoplastic material.

In particular, the thermoplastic material can be a recycled plastic, for example recycled polyethylene terephthalate, rPET. The rPET can, for example, come from beverage bottles (bottle flake chips) or metallized PET films. Alternatively or additionally, recycled polybutylene terephthalate (rPBT), recycled polylactic acid (rPLA), recycled polyglycolide and/or recycled polycaprolactone can also be used. Recycled polyolefins, in particular recycled polypropylene (rPP), recycled polyethylene and/or recycled polystyrene (rPS); recycled polyvinyl chloride (rPVC), recycled polyamides as well as mixtures and combinations thereof are also possible.

The base plate can be a punched, deep-drawn or injection-molded part. In other words, the base plate may have been produced by punching, deep-drawing (thermoforming) or injection molding.

The invention also provides a vacuum cleaner filter bag comprising a bag wall and a retainer plate connected thereto as described above.

The retainer plate may thus have one or more of the above features.

The bag wall of the vacuum cleaner filter bag may comprise one or more layers of filter material, in particular one or more layers of nonwoven fabric. Vacuum cleaner filter bags with such a bag wall consisting of several layers of filter material are known, for example, from EP 2 011 556 or EP 0 960 645. As material for the nonwoven layers, very different plastics can be used, for example polypropylene and/or polyester. In particular, the layer of the bag wall to be connected to the retainer plate can be a nonwoven layer. The bag wall of the vacuum cleaner filter bag can also comprise or consist of plastic recyclate. For example, the bag wall can be designed as described in EP 3 219 376 A1. The bag wall can be connected, in particular welded, to the base plate via the seal element. This allows bag wall and seal element to be connected together with the retainer plate, in particular the base plate, which simplifies manufacture.

The term nonwoven fabric ("nonwoven") is used according to the definition in ISO standard 1509092:1988 or CEM standard EN29092. In particular, the terms fiber fleece or fleece and nonwoven fabric in the field of manufacturing nonwoven fabrics are distinguished as follows and are also to be understood in the sense of the present invention in this way. Fibers and/or filaments are used to produce a nonwoven fabric. The loose and still unbonded fibers and/or filaments are called nonwoven or fiber fleece (web). By means of a so-called nonwoven bonding step, a nonwoven fabric is finally produced from such a fiber fleece, which has sufficient strength to be wound up into rolls, for example. In other words, a nonwoven fabric is made self-supporting by the bonding process. (Details on the use of the definitions and/or processes described herein can also be found in the standard work "Vliesstoffe" ["Nonwoven Fabrics"], W. Albrecht, H. Fuchs, W. Kittelmann, Wiley-VCH, 2000).

The bag wall may have a passage opening, in particular wherein the passage opening of the bag wall is aligned with the passage opening of the base plate. The passage opening in the base plate and the passage opening in the bag wall can form an inflow opening through which the air to be cleaned can flow into the interior of the vacuum cleaner filter bag.

The invention further provides a method of manufacturing a retainer plate, comprising providing a seal element comprising at least one extruded film made of a thermoplastic elastomer, TPE, and connecting the seal element to a base plate so that the seal element is arranged at the edge of a passage opening of the base plate.

The retainer plate thus produced may have one or more of the above features.

Figure 2:
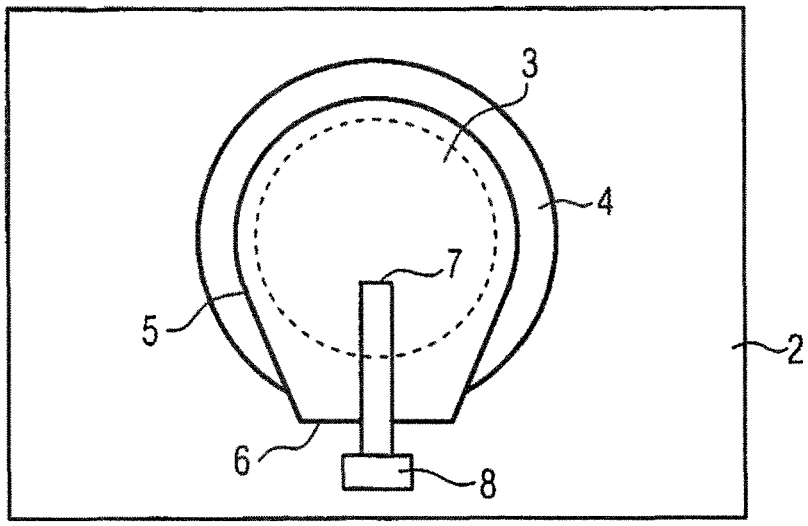

Further features and advantages of the invention are described below using the exemplary figures, of which:

FIG. 1 schematically shows the structure of an exemplary vacuum cleaner filter bag; and FIG. 2 shows the schematic structure of an exemplary retainer plate in a top view.

FIG. 1 shows the schematic structure of an exemplary vacuum cleaner filter bag. The filter bag comprises a bag wall 1, a retainer plate 2, and an inflow opening through which the air to be filtered flows into the filter bag. The inflow opening is here formed by a passage opening 3 in the base plate of the retainer plate 2 and a passage opening in the bag wall 1, which is aligned with it. The retainer plate 2 serves to fix the vacuum cleaner filter bag in a corresponding holder in a vacuum cleaner housing.

The bag wall 1 comprises at least one nonwoven layer, for example of a melt-spun fine fiber spunbonded nonwoven (melt-blown nonwoven) or a filament spunbonded nonwoven (spunbond).

The retainer plate 2 comprises a base plate made of a thermoplastic material. For example, recycled plastic material such as recycled polypropylene (rPP) or recycled polyethylene terephthalate (rPET) can be used for the base plate.

There are relevant international standards for many plastic recyclates. As for PET plastic recyclates, for example, DIN EN 15353:2007 is relevant.

The term "recycled plastics" used for the purposes of this invention is to be understood as synonymous with plastic recyclates. For the definition of the term, reference is made to the standard DIN EN 15347:2007.

A top view of an exemplary retainer plate, which can be used in combination with a filter bag as shown in FIG. 1, is shown in FIG. 2. It shows the retainer plate 2 with passage opening 3. The base plate of the retainer plate 2 is here schematically shown to be rectangular, but may have any shape, which may correspond in particular to the corresponding retaining device in the vacuum cleaner housing.

Moreover, FIG. 2 shows a seal element 4 arranged at the edge of the passage opening 3. The seal element 4 is intended to prevent or limit the escape of dust from the vacuum cleaner filter bag by sealing the area between the edge of the passage opening 3 and the outside of a connection nozzle of the vacuum cleaner. For this purpose, the seal element 4 comprises a passage opening which overlaps the passage opening 3 of the base plate. Since the area of the passage opening in the seal element 4 is smaller than the area of the passage opening 3 of the base plate, an annular sealing lip is formed which protrudes inwards over the edge of the passage opening 3 of the base plate, i.e. towards the center of the passage opening 3.

The seal element 4 is welded to the base plate and comprises at least one extruded film of a thermoplastic elastomer, TPE, connected to the base plate.

An element whose thickness is considerably less than its extension perpendicular to it (length and width) is designated as a film. For example, the film may have a thickness, particularly a constant thickness, of less than 0.35 mm, for example 0.13 mm.

Unlike injection-molded seal elements, the seal element 4 can be made of a thermoplastic elastomer with a low melt flow index, in particular a melt flow index of less than 10 g/10 min. The melt flow index is defined according to ISO 1133 and is measured by means of a capillary rheometer. The melt flow index indicates the mass of the thermoplastic melt which is forced through a predetermined nozzle under a predetermined pressure in 10 minutes.

The at least one extruded film can be a blown film or a cast film.

It has been found that such extruded films have a higher elasticity than injection-molded structures. Therefore, the sealing effect of the seal element 4 is improved compared to injection-molded sealing lips.

The seal element 4 may have a greater roughness on the side with which it comes into contact with the nozzle of the vacuum cleaner during operation than on the opposite side. This can be achieved by calendering a surface structure onto the film.

The seal element 4 can also comprise several layers of extruded films, wherein the layers can consist of a uniform plastic or of different plastics. In particular, the layer to be connected to the base plate may comprise a plastic which is compatible with the plastic material of the base plate so that a secure welded joint can be produced.

FIG. 2 also shows an optional closure flap 5 which can be pivoted around a hinge 6. The hinge 6 is specifically a film hinge. The closure flap 5 serves to close the passage opening 3 when the vacuum cleaner is not in use, especially when the filter bag is removed from the vacuum cleaner.

The closure flap 3 may also be made of a recycled plastic material, for example the same material as the base plate.

The closure flap 5 is pretensioned in the closing position by a spring element 7. The spring element 7 may be made of a new plastic material molded onto the closure flap 5. Alternatively, other known spring elements, for example a metallic leaf spring, can be used. To influence the spring characteristic curve, a spring pocket 8 is provided which can be designed according to EP 1 849 392 A1.

In this example, the spring element 7 is arranged in front of the closure flap 5, seen in the closing direction. The top view of FIG. 2 is thus on the side of the retainer plate 2 which is to be connected to the bag wall 1. The spring element 7 is therefore located in the dust compartment, i.e. inside the filter bag, after connecting the retainer plate 2 to the vacuum cleaner filter bag.

It goes without saying that features mentioned in the embodiments described above are not limited to these special combinations and are also possible in any other combination. It is also understood that geometries shown in the figures are only exemplary and are also possible in any other design.

The invention claimed is:

1. A vacuum cleaner filter bag, comprising: a retainer plate, the retainer plate comprising:

a base plate with a passage opening arranged therein, and a seal element arranged at an edge of the passage opening, wherein the seal element comprises at least one extruded film made of a thermoplastic elastomer (TPE), wherein the at least one extruded film has a first side and an opposite second side, wherein the first side has a greater roughness than the second side, and wherein the second side points towards a dust compartment of the vacuum cleaner filter bag.

2. The vacuum cleaner filter bag according to claim 1, wherein the at least one extruded film is a blown film or a cast film.

3. The vacuum cleaner filter bag according to claim 1, wherein the thickness of the at least one extruded film is less than 0.35 mm.

4. The vacuum cleaner filter bag according to claim 1, wherein the at least one extruded film is welded to the base plate.

5. The vacuum cleaner filter bag according to claim 1, wherein the seal element comprises several layers of extruded films made of the TPE.

6. The vacuum cleaner filter bag according to claim 5, wherein at least two of the layers of extruded films consist of different plastics.

7. The vacuum cleaner filter bag according to claim 1, wherein the base plate comprises a thermoplastic material.

8. The vacuum cleaner filter bag according to claim 7, wherein the thermoplastic material is a recycled plastic.

9. The vacuum cleaner filter bag according to claim 8, wherein the recycled plastic comprises recycled polyethylene terephthalate (rPET).

10. The vacuum cleaner filter bag according to claim 1, wherein the base plate is a punched part, a deep-drawn part or an injection-molded part.

11. The vacuum cleaner filter bag according to claim 1, wherein the thickness of the at least one extruded film is less than 0.25 mm.

12. The vacuum cleaner filter bag according to claim 1, wherein the thickness of the at least one extruded film is less than 0.15 mm.

13. The vacuum cleaner filter bag according to claim 1, wherein the melt flow index of the thermoplastic elastomer of the at least one extruded film is less than 5 g/10 min.

14. The vacuum cleaner filter bag according to claim 1, wherein the melt flow index of the thermoplastic elastomer of the at least one extruded film is less than 3 g/10 min.

15. The vacuum cleaner filter bag according to claim 1, wherein the melt flow index of the thermoplastic elastomer of the at least one extruded film is less than 10 g/10 min.

* * * * *